US006175968B1

(12) United States Patent
Schneider

(10) Patent No.: US 6,175,968 B1
(45) Date of Patent: Jan. 23, 2001

(54) TRANSPORTABLE AND FOLDABLE TOILET SEAT ATTACHMENT DEVICE

(75) Inventor: Phillip G. Schneider, Davison, MI (US)

(73) Assignee: Joyce M. Schneider, Davison, MI (US)

( * ) Notice: Under 35 U.S.C. 154(b), the term of this patent shall be extended for 0 days.

(21) Appl. No.: 09/477,075

(22) Filed: Jan. 3, 2000

(51) Int. Cl.[7] ..... A47K 13/00
(52) U.S. Cl. ..... 4/239; 4/248
(58) Field of Search ..... 4/237, 239, 248

(56) References Cited

U.S. PATENT DOCUMENTS

| | | | | |
|---|---|---|---|---|
| 52,581 | * | 2/1866 | Sondheim | 4/239 |
| 82,636 | * | 9/1868 | Perkins | 4/239 X |
| 972,820 | * | 10/1910 | Cleis | 4/248 |
| 2,537,504 | * | 1/1951 | Anderson | 4/239 |
| 3,986,215 | | 10/1976 | Amalfitano | 4/236 |
| 4,930,165 | * | 6/1990 | Wilson | 4/239 X |
| 5,005,223 | | 4/1991 | Greenwood | 4/235 |
| 5,060,319 | | 10/1991 | Laroue | 4/239 X |
| 5,095,556 | | 3/1992 | Franey | 4/483 X |
| 5,267,355 | | 12/1993 | Landman | 4/237 |
| 5,542,131 | | 8/1996 | Brantman | 4/239 |
| 5,781,940 | | 7/1998 | Becker et al. | 4/483 |
| 5,787,514 | | 8/1998 | Erli | 4/239 |
| 5,802,624 | | 9/1998 | Brantman | 4/239 |
| 5,940,896 | | 8/1999 | Berring | 4/237 X |

* cited by examiner

*Primary Examiner*—Robert M. Fetsuga

(74) *Attorney, Agent, or Firm*—Gifford, Krass, Groh, Sprinkle, Anderson & Citkowski, P.C.

(57) ABSTRACT

A transportable and foldable toilet seat attachment device for use with a conventional toilet, the toilet including a bowl with an upwardly facing rim onto which is pivotably engaged a conventional toilet seat cover. The attachment device includes a first generally arcuate shaped portion having an established length, width and thickness and a second likewise arcuate shaped portion being a substantially a mirror image of the first portion and being pivotally attached to the first portion at first and second respective and opposing ends established along a common axis. The first and second arcuate shaped portions each have an outer extending edge, a spaced and inner extending edge defining the width of the arcuate portion, an upwardly facing surface and a downwardly facing surface, the first and second arcuate portions further defining therebetween a central opening of a selected dimension. A first handle extends from the outer extending edge of the first arcuate portion at a selected location and a second handle extends from the outer extending edge of the second arcuate portion at an opposite location relative to the first handle. The first and second handles each include resistive interengaging portions to interlock together the handles and are adaptable to convert the attachment device to a folded position for transport and storage. First and second pluralities of elongate and radially extending support pads are attached to the downwardly facing surfaces of the first and second arcuate shaped portions. The pads resistively engages the conventional toilet seat cover upon converting the attachment device to its unfolded and use position, the pads further spacing the upwardly facing surfaces of the first and second arcuate portions from the corresponding upper surface of the toilet seat cover while centrally aligning the central opening with the upwardly facing toilet bowl rim.

13 Claims, 4 Drawing Sheets

TRANSPORTABLE AND FOLDABLE TOILET SEAT ATTACHMENT DEVICE

BACKGROUND OF THE INVENTION

1. Field of the Invention

The present invention relates generally to portable and foldable toilet seat assemblies and, more particularly, to such a hygienic, sanitary and transportable/foldable toilet seat which is universally adaptable to existing toilet bowls and conventional toilet seats according to most makes or models and which provides the combined features of a sure, non-sliding grip when placed in position upon a standard toilet bowl/seat assembly, as well as preventing the possibility of pinching or harming the user while in use.

2. Description of the Prior Art

Toilets and toilet bowl assemblies are very well known in the art. The typical toilet bowl assembly includes a porcelain toilet bowl with a flushing trigger attached to an interconnected and upwardly extending water storage and flow unit. Depressing the trigger causes a held volume of the fluid contained within the storage unit to flow through the bowl and to discharge its contents through the sewage outline to which it is interconnected. The upwardly extending unit then refills to a selected level, at which point a mechanical switch closes a valve located in an inflow water line to the unit. Finally, the bowl assembly her includes a hingedly connected and conventional seat assembly which is typically of a generally horseshoe shape configuration.

A constant problem with conventional toilet bowl and toilet seat assemblies is the desire to maintain, to the greatest extend possible, hygienic and sanitary conditions. This is particularly of concern in situations where the toilet is located in a public facility and is likely to be used by a number of different individuals. One attempt in the background art has been to utilize the pull-out toilet covering sheet or paper which is mounted, in a package of many such sheets, to a dispenser, the dispenser typically being adhered to a wall surface behind the toilet. The purpose of the tissue covering is that the user applies it as a covering over the existing and upwardly facing toilet seat surface. Problems with such a sheet or tissue dispenser include the relative flimsiness of the paper covering, causing it to easily tear or become uncovered from the top surface of the toilet seat, combined with the fact that the thin layer of fragile covering material provides, at best, only a very marginal degree of hygienic protection.

A further example of a foldable toilet seat arrangement is illustrated in U.S. Pat. No. 5,005,223, issued to Greenwood. The Greenwood references teaches a foldable portable toilet seat providing front and rear sections which are pivotably connected by hinges. The lower surface of each front section includes a downwardly extending flange for engaging a conventional toilet seat to prevent slipping or movement. The flange of each front section further interfits within a hollow raised portion of the corresponding rear section when the sections are folded for transport or storage. A further observation is that the device illustrated in Greenwood collapses into a quarter-sized folded position. A central opening defined by the employed Greenwood device is also very small in dimension, concurrent with its primary teaching of the provision of a toilet training device for infants. Hinge means are provided for interconnecting the quarter sections defining the seat construction, however it is evident that some danger to the user could still be evident in the form of pinching the skin during use of the device.

Referring further to U.S. Pat. Nos. 5,802,624 and 5,542,131, both issued to Brantman, additional examples are illustrated of sectional toilet seat assemblies, each including a lower seat member which supports an upper seat member having a removable section. The removable section constitutes less than a majority of the seating surface of the upper seat member and a method associated with the invention discloses the ability to transfer a person onto the remaining upper seat member and replacing the removed upper seat section while the person is supported by the remaining upper seat member.

Finally, U.S. Pat. No. 5,787,514, issued to Erli, and U.S. Pat. No. 5,267,355, issued to Landman, each teach additional variations of portable toilet seats which include a plurality of coplanar and slidably adjustable/collapsible arcuate seat portions and which permit each to be collapsed to a smaller size. The problem with both Erli and Landman resides in the fact that the fair degree of sophistication and mechanical interface which is required to extend and collapse the coplanar and arcuate seat portions is more prone to breakage and, furthermore, such devices tend to provide fertile breeding grounds for germs and bacteria. Accordingly, the prior art has, heretofore, failed to produce a simplified, convenient and effective approach to providing an easily portable, foldable and hygienic seat which is capable of being used by an individual and which provides a greater degree of safety and ease of use and cleaning.

SUMMARY OF THE PRESENT INVENTION

The present invention is a transportable and foldable toilet seat attachment device which is particularly suited for use with a conventional toilet. The goal of the present invention is to provide a durable and resilient foldable toilet seat which maximizes efficiency of use, while maintaining the highest possible level of sanitation. Additional goals include providing such a foldable seat attachment device which eliminates the possibility of "pinching" of the user's skin during application, as well as slipping of the device relative to the toilet seat cover which is pivoted into position over the porcelain toilet rim.

The attachment device includes a first generally arcuate shaped portion having an established length, width and thickness. Typically, the arcuate portion is a substantially semi-circular or "C" shaped configuration. A second likewise arcuate shaped portion is substantially a mirror image of the first portion and is pivotally attached to the first portion at first and second respective and opposing ends established along a common axis, such connection being typically provided by first and second flexible and resilient living hinges extending along the common axis. The first and second arcuate shaped portions each having an outer extending edge, a spaced and inner extending edge defining therebetween the width of the selected arcuate portion, an upwardly facing surface and a downwardly facing surface. The first and second arcuate portions further define therebetween a central opening of a selected dimension.

A first handle extending from said outer extending edge of said first arcuate portion at a selected location and a second handle extending from the outer extending edge of the second arcuate portion at an opposite location relative to the first handle. The first and second handles each further include first and second reinforcing flange portions for fixing the handles to the associated arcuate portions. The first and second handles each further include a resistive interengaging slot and projection such that, upon pivoting said first and second arcuate shaped portions from an unfolded and use position to a folded position, the handles interlock together and are adaptable to convert the attachment device for transport and storage.

First and second pluralities of elongate and radially extending support pads are provided and are secured to the downwardly facing surfaces of the first and second arcuate shaped portions. Each of the downwardly facing surfaces of the arcuate shaped portions further include spaced apart and individual pairs of narrow and elongate web portions extending between the downwardly angled edge contours of the outer and inner extending edges. Each of the pairs of web portions further include spaced apart and crosswise extending members defining a pocket, each of the support pads including a three dimensional engaging portion which is resistively received within the pocket and biasingly engages the associated support pad in place. The pads resistively engage the conventional toilet seat cover upon converting the attachment device to its unfolded and use position, the pads further spacing said upwardly facing surfaces from the corresponding upper surface of the toilet seat cover while centrally aligning the central opening with the upwardly facing toilet bowl rim.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
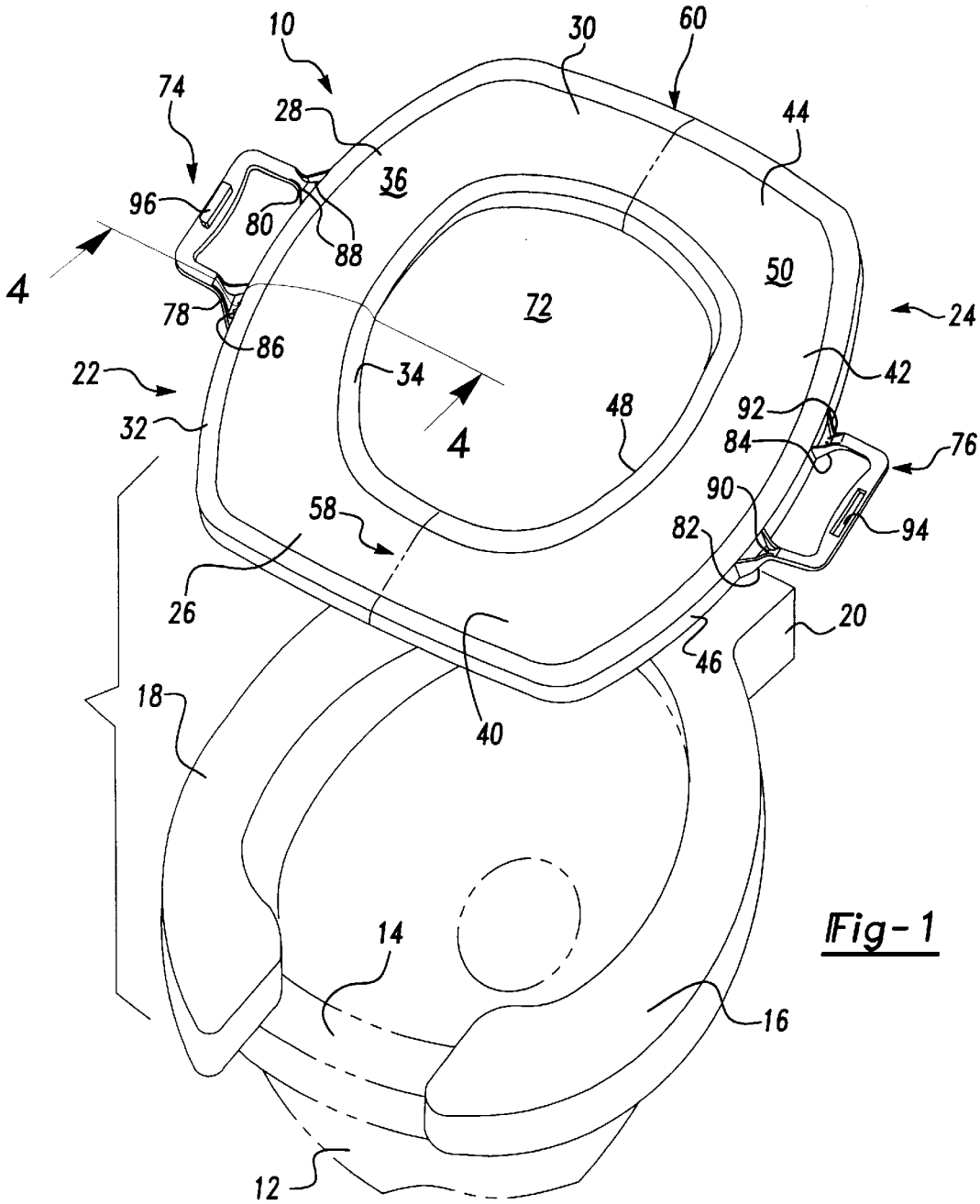
FIG. 1 is a perspective view of the toilet seat attachment device according to the present invention illustrated in an upwardly spaced distance from a conventional toilet bowl and pivotable seat.

Referring now to FIG. 1, a perspective view is illustrated at 10 of a toilet seat attachment device according to the present invention illustrated in an upwardly spaced distance from a conventional porcelain toilet bowl 12 defining an upwardly facing rim 14. A conventional toilet bowl seat includes first and second arcuate shaped and oppositely extending portions 16 and 18 and which interconnect along a rear edge at 20. The toilet bowl seat is pivotably secured to the toilet bowl 12 at the rear location, as is well known in the art, and so that the seat is pivotably engaged in a downward position, as shown in FIG. 1, during normal use of the toilet.

The toilet seat attachment device 10 includes a first generally arcuate shaped portion 22 and a second generally arcuate shaped portion 24. The seat attachment device 10 of the present invention is further constructed of any suitable material exhibiting the properties of strength and durability, but is preferably a strong and impact-resistant plastic or like material which is capable of operating in a corrosive resistant and sanitary manner.

Each of the arcuate shaped portions 22 and 24 are formed in a generally semi-circular or "C" shaped configuration with an established length, width and height. More specifically, the first arcuate shaped portion 22 includes a forward-most extending portion 26, an intermediate extending portion 28, and a rearward portion 30. The first arcuate shaped portion 22 is further defined by an outer extending edge 32, a spaced and inner extending edge 34 defining therebetween the width of the first portion 22, an upwardly facing surface 36 and a downwardly facing surface 38. The second arcuate shaped portion 24 includes a forward-most extending portion 40, an intermediate extending portion 42, and a rearward portion 44. The second arcuate shaped portion 24 is further defined by an outer extending edge 46, a spaced and inner extending edge 48 defining therebetween the width of the second portion 24, an upwardly facing surface 50 and a downwardly facing surface 52. As is also best shown in the cutaway view of FIG. 4, the outer and inner extending edges of the first and second arcuate shaped portions, as depicted by the cutaway of the first portion 22, each further include a downwardly angled edge contour (see at 54 and 56, respectively for outer edge 32 and inner edge 34). The purpose of the downward edge contours is to firstly provide a comfortable seating surface area for the user and secondly to facilitate the installation of additional structure to the downwardly facing surfaces 38 and 52 of the arcuate shaped portions as will be subsequently described.

Figure 7:
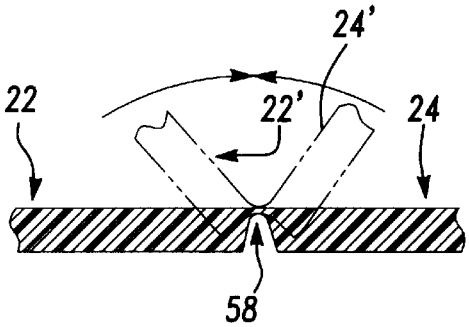
FIG. 7 is a cutaway view taken along line 7—7 of FIG. 2 and illustrating a living hinge established along the common axis defined between the interconnection of the first and second arcuate shaped portions.
Figure 8:
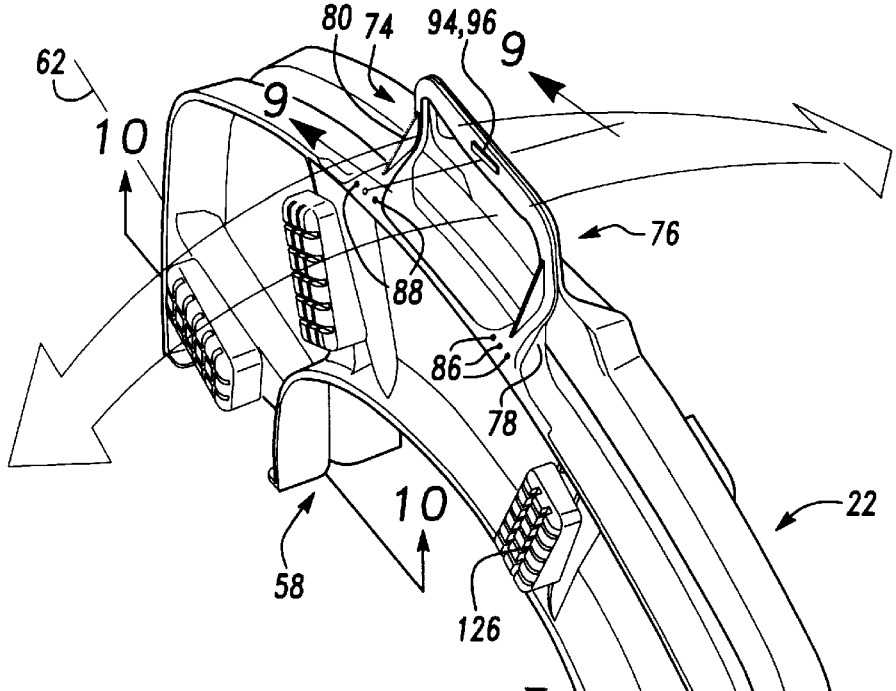
FIG. 8 is a further operative view of the toilet seat attachment device illustrated in a folded position in which the first and second handles are resilient engaged together and further showing the manner in which the arcuate shaped halves are detached and downwardly folded to its use position.
Figure 10:
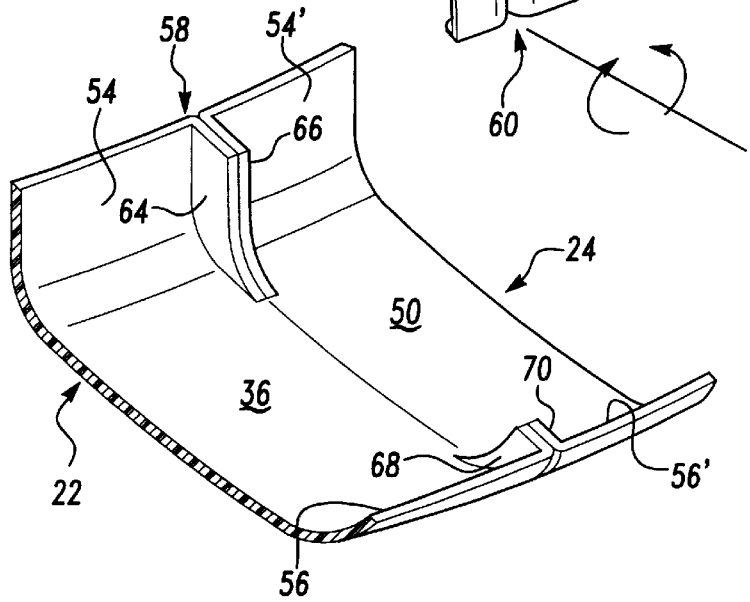
FIG. 10 is an end view along line 10—10 of FIG. 8, assuming the attachment device to be in its unfolded and use position, and illustrating in greater detail the reinforcing web portions extending from the angled edge contours of the arcuate portions along the axis defined by the living hinges.

Referring again to FIG. 1, as well as to FIGS. 7 and 10, the first and second arcuate shaped portions 22 and 24 extend in opposing and mirrored fashion relative to one another and are pivotally interconnected at first and second respective and opposing ends 58 and 60. More particularly, the interconnecting ends 58 and 60 extend along a common axis, as defined at 62 in FIG. 8, and permit the arcuate shaped portion 22 and 24 to be pivoted from a first unfolded and use position, as shown in FIG. 1, to a second folded and storage or transport position, as illustrated in FIG. 8. Although not illustrated, a separate carrying case or other suitably constructed and configured carrying bag may be employed for transporting the device 10 when no in use.

Referring again to the opposing and axial ends 58 and 60 and to FIG. 7 in particular, these are preferably provided by living hinges which are constructed as an integral part of the attachment seat material and are more specifically narrowed and hinged interconnections which permit the arcuate portions 22 and 24 to pivot between the unfolded position to a folded position (see at 22' and 24' in FIG. 7) along the directions indicated. The living hinges are further constructed according to technology known in the art and are such that the material content will not cause the hinge to weaken or shear in repeated use. Referring again specifically to FIG. 10, first and second abutting pairs of reinforcing web portions extend from the outer and inner downwardly angled edge contours (see again contours 54 and 56 of the first arcuate shaped portion 22, as well as identical such contours 54' and 56' indicated at corresponding and opposing second arcuate shaped portion 24) and serve to reinforce the connection between the living hinges. Specifically, a first pair of such web portions 64 and 66 are formed in axial fashion along the abutting edge contours 54 and 54' and a second pair 68 and 70 and formed along the abutting edge contours 56 and 56', both pairs extending along the downwardly facing surfaces 36 and 50 of the arcuately facing portions 22 and 24. The first and second arcuate portions 22 and 24 further define therebetween a central opening 72 of a selected dimension, this being particularly suited for being arrayed over the corresponding opening defined by the toilet bowl rim 14 in a secured and spaced fashion as will be subsequently described.

A first handle 74 extends from the outer extending edge 32 of the first arcuate portion 22 at a selected location, typically in the center of the intermediate extending portion 28. A second handle 76 likewise extends from the outer extending edge 46 of the second arcuate portion 24 at an opposite location relative to the first handle 74 and typically also at a central location relative to the intermediate extending portion 42. Each of the first and second handles 74 and 76 are further constructed, in a preferred variant, with a generally "U" shaped configuration with first and second connecting ends and an intermediate and lengthwise extending and spaced member as is clearly shown in the drawing illustrations.

The first and second handles 74 and 76 each further include first and second reinforcing flange portions, see at 78 and 80 for first handle 74 and at 82 and 84 for second handle 76. Referring again to the enlarged cutaway shown in FIG. 4, the first such reinforcing flange portion 78 is illustrated and it is clear how it is configured relative to the interconnection of the handle 74 to the seat portion 22 and so as to maximize the strength of that connection. The reinforcing flange portions therefore secure the associated handles 74 and 76 to the outer extending edges of the arcuate shaped portions in a durable manner. Pluralities of drainage holes are formed through each of reinforcing flange portions in proximity to the outer extending edges of the arcuate seat portions 22 and 24 and are specifically shown by drainage holes 86 and 88 for associated flange portions 78 and 80 of the first handle 74 and by drainage holes 90 and 92 for associated flange portions 82 and 84 of the second handle 76. Typically, a series of three such drainage holes are provided through each reinforced flange portion and this is also shown again by the pluralities of drainage holes 86 and 88 of the first handle 74 as evident by the folded position of the attachment seat in FIG. 8.

Figure 9:
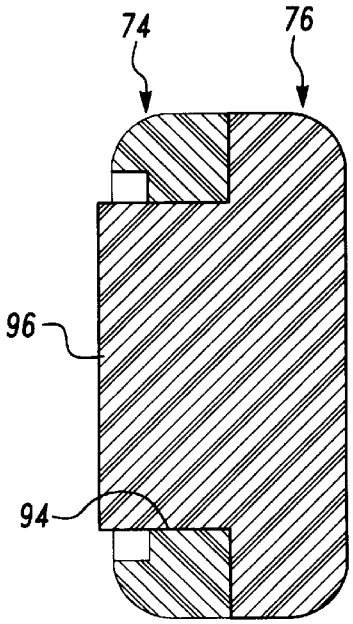
FIG. 9 is a cutaway view taken along line 9—9 of FIG. 8 and illustrating in greater detail the interengaging slot and projection established between the first and second handles for locking the device in its folded position.

The first and second handles each also include resistive interengaging portions such that, upon pivoting the first and second arcuate shaped portions 22 and 24 from the unfolded and use position to the folded position, the handles interlock together and are adaptable to convert the attachment device to the transport and storage position. Specifically, a slot 94 is formed through the intermediate spaced and extending portion of the first handle 76, the slot 94 aligning with a correspondingly shaped projection 96 extending in opposing fashion from the first handle 74. The projection 96 is received within the slot 94 in resistive fashion to biasingly lock the first and second handles in place in the folded position. See also the cutaway view of FIG. 9 which illustrates this biasing engagement.

Figure 4:
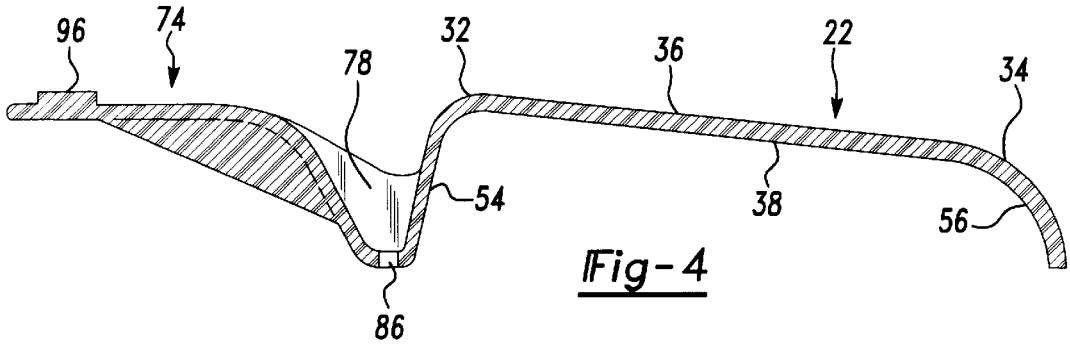
FIG. 4 is a cutaway view taken along line 4—4 of FIG. 1 and further illustrating one of the reinforced and interconnecting flange portions with drainage holes established between a handle portion and the outer connecting edge of the associated arcuate shaped portion.
Figure 2:
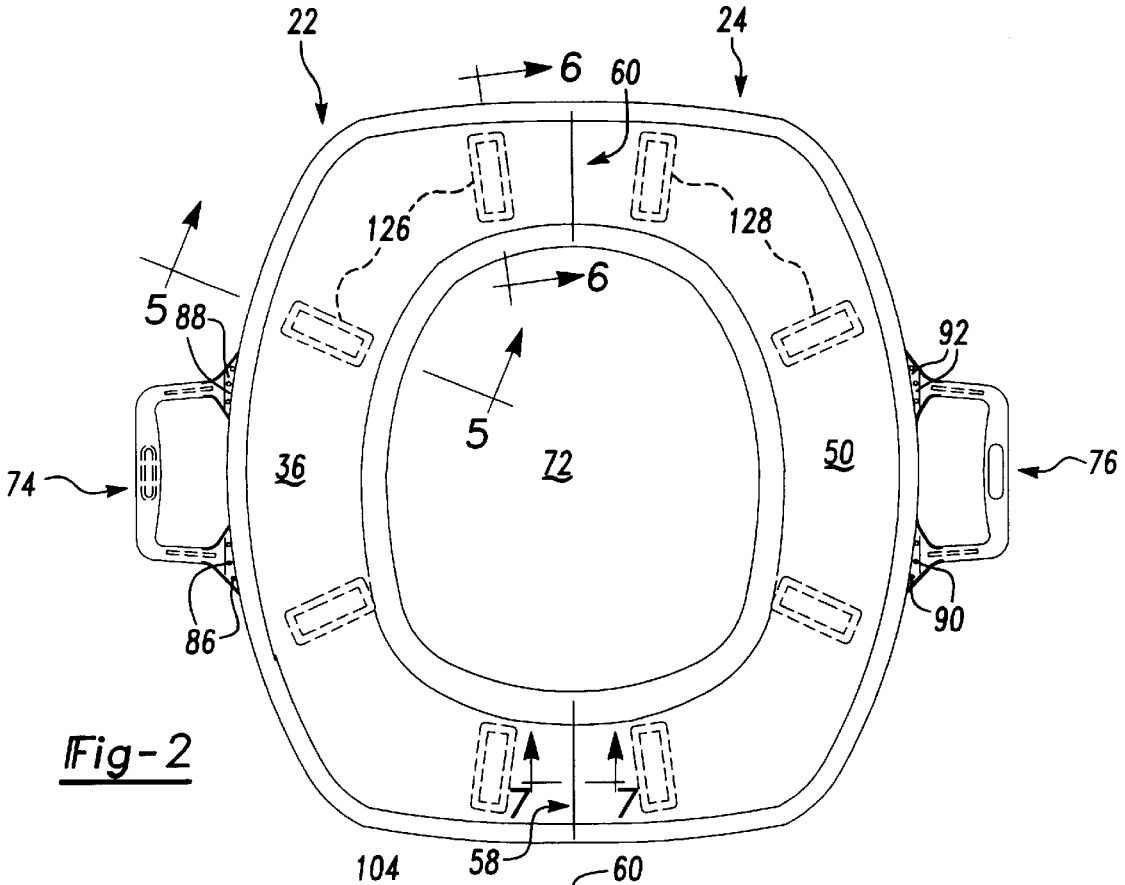
FIG. 2 is an top plan view of the toilet seat attachment device shown in FIG. 1 and further illustrating in phantom the arrangement of the pluralities of support pads for spacing the upwardly facing surfaces of the arcuate shaped portions from the conventional toilet seat cover.
Figure 3:
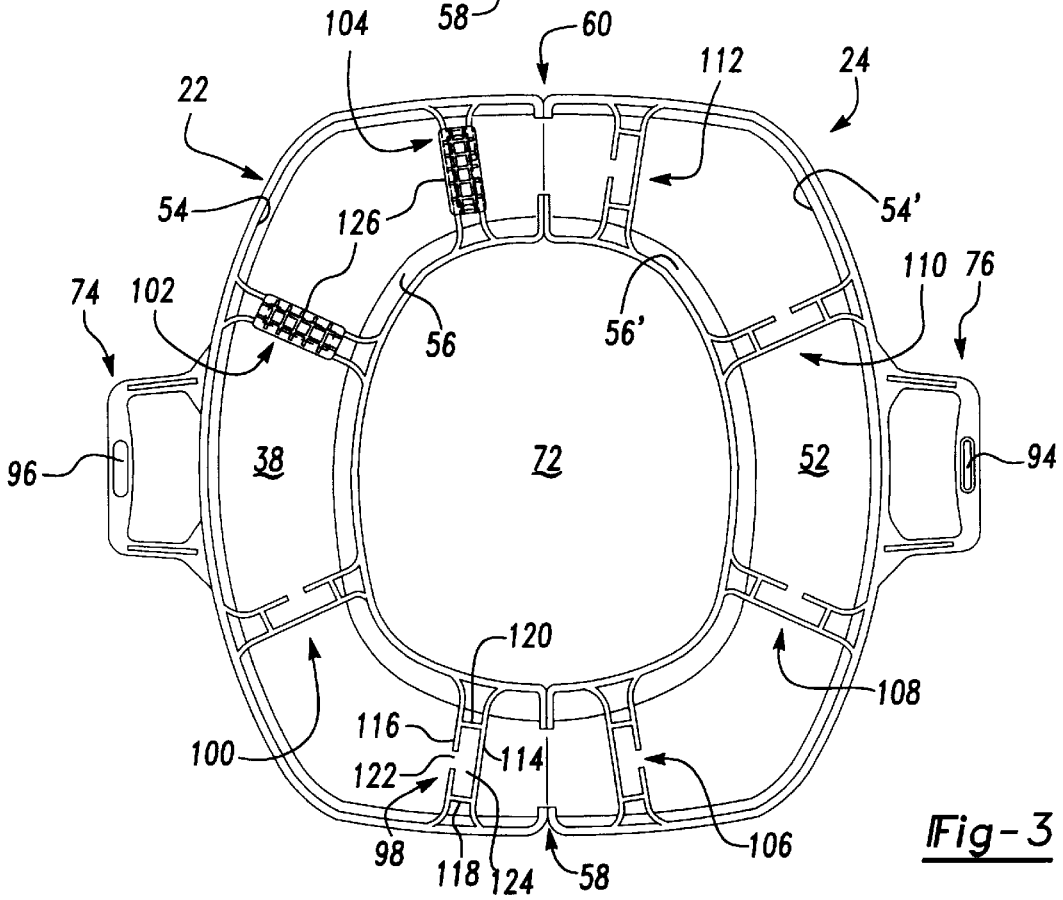
FIG. 3 is a view similar to that shown in FIG. 2 and illustrating a bottom plan view of the toilet seat attachment device with elongated web portions for receivably mounting the support pads.

Referring now to FIGS. 3 and 4, spaced apart and individual pairs of narrow and elongate web portions extend between the downwardly angled edge contours 54 and 56 and 54' and 56' of the outer and inner extending edges of both arcuate shaped portions 22 and 24. The pairs of web portions are indicated at 98, 100, 102 and 104 for the first arcuate shaped portion 22 and at 106, 108, 110 and 112 for the second arcuate shaped portion 24. Each of the pairs of web portions further including spaced apart and crosswise extending members defining a pocket. Without duplicating this disclosure for each such pair of web portions illustrated, reference is made to the first pair indicated at 98 in FIG. 3 for the first support portion 22 and which shows a first elongate and narrow extending web member 114 and a second closely spaced and parallel extending member 116. Spaced apart and crosswise extending members 118 and 120 extend between the first and second web members 114 and 116 and define a pocket therebetween. A drainage gap is formed at 122 along one of the web members, in this case web member 116, and accesses the pocket formed at 124. Without repeating this description for each and every of the pair of web portions 98–112, it is evident that all are constructed in an identical fashion such that a repetitive description is unnecessary and so that the web portions 98–112 provide the necessary degree of drainage to the underside of the assembly.

First and second pluralities of elongate and radially extending support pads are provided at 126 and 128 and are capable of being secured to the downwardly facing surfaces of said first and second arcuate shaped portions 22 and 24. Each of the support pads are constructed of a rubberized or like material having a significant degree of frictional resistance and with a body of generally rectangular and three dimensional shape. Each pad further includes a three dimensional engaging portion extending downwardly which is resistively received within an associated pocket defined by a corresponding pair of web portions (again 98–112) and which biasingly engages the associated support pad in place. Reference is made to the cutaway views of FIGS. 5 and 6 which show, at 130 and 132, respective cutaway views of first and second subpluralities of the support pads 126.

Figure 5:
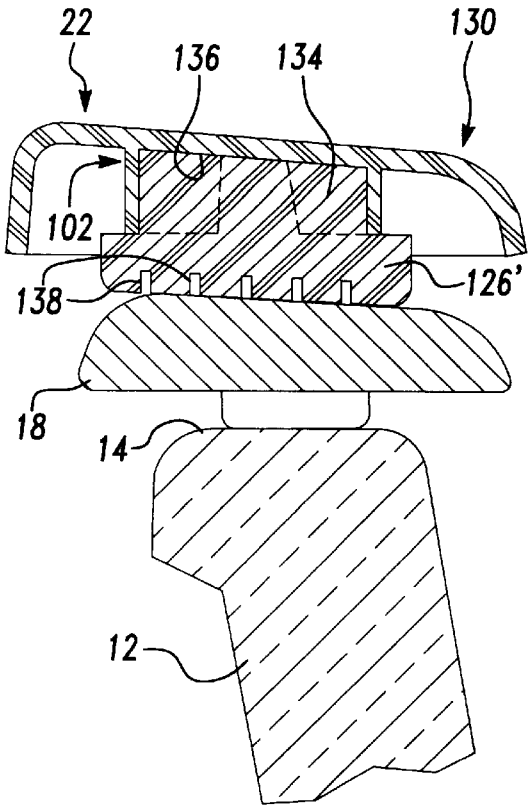
FIG. 5 is a cutaway view taken along line 5—5 of FIG. 2 and illustrating a first configuration of a support pad associated with an intermediate extending portion of a first selected arcuate shaped portion.

Specifically, a first sub-plurality of the attachment pads is shown at 130 according to the cutaway of FIG. 5 and is constructed according to a first configuration for use along the forward-most and intermediate extending portions of either arcuate shaped portion 22 or 24. Specifically, the pad 126' shown in FIG. 5 includes a three dimensional engaging portion 134 extending from one side and which is received in resistive fashion within the pocket associated with the corresponding pair of web portions, in this case web portions 102. The engaging portion 134 of the pad 126' further includes a first defined slope 136 which corresponds to a generally downward slope of the first arcuate portion 22 along the front and intermediate extending portions and in a direction from the outer extending edge 32 to the inner extending edge 34. A plurality of teethed portions 138 are formed upon a downwardly facing surface of the support pad 126' and facilitate non-slip engagement of each of the pads against the upper surface of the conventional toilet seat.

Figure 6:
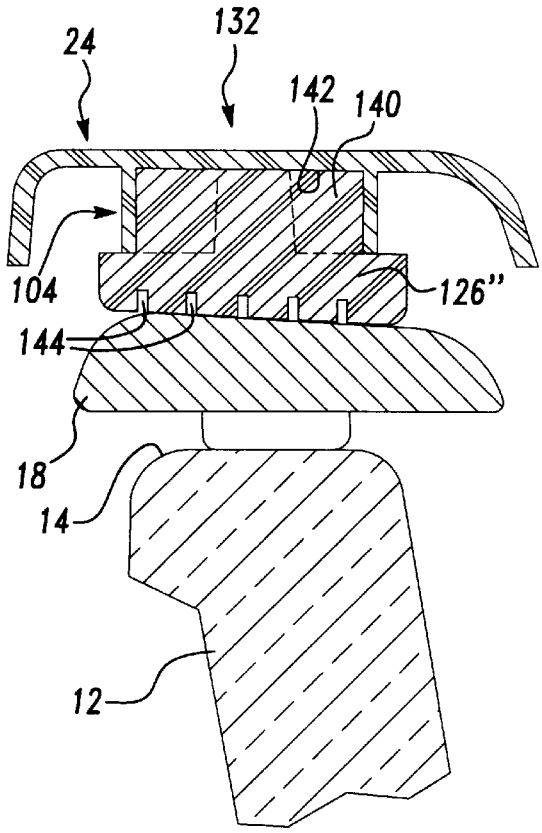
FIG. 6 is a cutaway view taken along line 6—6 of FIG. 2 and illustrating a second configuration of a support pad associated with a rearward portion of the first selected arcuate shaped portion.

A second sub-plurality of said attachment pads, such as shown at 132 in FIG. 6, are constructed according to a second configuration 126" for use along the rearward portions of either arcuate shaped portion 22 or 24. As with the pad 126' shown in FIG. 5, the pad 126" according to the further configuration includes a three dimensional engaging portion 140 extending from one side and which is received in resistive fashion within the pocket associated with the corresponding pair of web portions, in this case web portions 104. The engaging portion 140 of the pad 126" further includes a second defined slope 142 of a slightly different value and which likewise extends from the outer extending edge 34 to the inner extending edge 34. The sloping of the arcuate seat portions 22 and 24, as illustrated by reference to FIGS. 5 and 6, concerning the first portion 22, provide an optimum of seating comfort to the user. As with the support pad 126', a plurality of teethed portions 144 are formed upon a downwardly facing surface of the support pad 126" and likewise facilitate non-slip engagement of each of the pads against the upper surface of the conventional toilet seat.

An advantage of the support pads 126 and 128 is that they are easily removable from their associated pockets defined in the pairs of web portions, such as for cleaning or replacement. Also, while an exhaustive description has been made of the sub-plurality configurations of the pads 126' and 126" of the plurality 126 of pads, it is also understood that the corresponding pads 128 of the second plurality are identically constructed such that an identical description is unnecessary.

Having described my invention, it will become apparent that it discloses a novel and unique toilet seat attachment device in which the pluralities of pads are arrayed opposite the downwardly facing surfaces of the first and second arcuate shaped portions upon arranging the device 10 in the manner illustrated in FIG. 1. The pads resistively engage the conventional toilet seat cover upon converting the attachment device to its unfolded and use position, the pads further spacing the upwardly facing surfaces from the corresponding upper surface of the toilet seat cover, as again shown in the cutaway views of FIGS. 5 and 6, and while centrally aligning the central opening 72 of the attachment device 10 relative to the upwardly facing toilet bowl rim.

Additional preferred embodiments will become apparent to those skilled in the art to which it pertains and without deviating from the scope of the appended claims.

I claim:

1. A transportable and foldable toilet seat attachment device for use with a conventional toilet, the toilet including a bowl with an upwardly facing rim onto which is pivotably engaged a conventional toilet seat cover, said attachment device comprising:

a first generally arcuate shaped portion having an established length, width and thickness, a second likewise arcuate shaped portion being a substantially a mirror image of said first portion and being pivotally attached to said first portion at first and second respective and opposing ends established along a common axis, said first and second arcuate shaped portions each having an outer extending edge, a spaced and inner extending edge defining therebetween said width, an upwardly facing surface and a downwardly facing surface, said first and second arcuate portions further defining therebetween a central opening of a selected dimension;

a first handle extending from said outer extending edge of said first arcuate portion at a selected location, a second handle extending from said outer extending edge of said second arcuate portion at an opposite location relative to said first handle, said first and second handles each including resistive interengaging means such that, upon pivoting said first and second arcuate shaped portions from an unfolded and use position to a folded position, said handles interlock together and are adaptable to convert said attachment device for transport and storage;

first and second pluralities of elongate and radially extending support pads and securing means for attaching said pads to said downwardly facing surfaces of said first and second arcuate shaped portions, said pads resistively engaging the conventional toilet seat cover upon converting said attachment device to its unfolded and use position, said pads further spacing said upwardly facing surfaces from the corresponding upper surface of the toilet seat cover while centrally aligning said central opening with the upwardly facing toilet bowl rim.

2. The toilet seat attachment device according to claim 1, said outer and inner extending edges of said first and second arcuate shaped portions each further comprising a downwardly angled edge contour.

3. The toilet seat attachment device according to claim 1, said securing means for attaching said pluralities of support pads to said first and second arcuate shaped portions further comprising spaced apart and individual pairs of narrow and elongate web portions extending between said downwardly angled edge contours of said outer and inner extending edges, each of said pairs of web portions further including spaced apart and crosswise extending members defining a pocket, each of said support pads further including a three dimensional engaging portion which is resistively received within said pocket and biasingly engages said associated support pad in place.

4. The toilet seat attachment device according to claim 3, further comprising means for draining fluid from both said downwardly facing surfaces of said arcuate shaped portions and from said first and second handles.

5. The toilet seat attachment device according to claim 4, further comprising a selected one of each pair of narrow and elongate web portions including a gap formed therein and revealing said associated pocket.

6. The toilet seat attachment device according to claim 4, each of said first and second handles further comprising including first and second reinforcing flange portions for securing said associated handle to said arcuate shaped portion, a plurality of drainage holes being formed through each of said flange portions.

7. The toilet seat attachment device according to claim 2, said pivotally attaching of said first arcuate shaped portion to said second arcuate shaped portion further comprising first and second flexible and resilient living hinges extending along said common axis established between said first and second respective and opposing ends.

8. The toilet seat attachment device according to claim 7, further comprising pivotable and abutting pairs of reinforcing web portions extending from said outer and inner downwardly angled edge contours and in axial fashion with respect to each of said first and second living hinges.

9. The toilet seat attachment device according to claim 1, said means for resistively interengaging said first and second handles further comprising a slot formed through a central extending member of said first handle, said slot aligning with a correspondingly shaped projection extending in opposing fashion from said second handle, said projection being received within said slot in said resistive fashion to biasingly lock said first and second handles in place in said folded position.

10. The toilet seat attachment device according to claim 3, each of said first and second arcuately shaped portions including a forward-most extending portion, an intermediate extending portion and a rearward portion, said upwardly facing surfaces of said arcuate shaped portions exhibiting a first contour along said forward-most and intermediate extending portions, said upwardly facing surfaces exhibiting a second contour between said inner extending edge and said outer extending edge and along said rearward portions.

11. The toilet seat attachment device according to claim 10, further comprising a first sub-plurality of said attachment pads being constructed according to a first configuration for use along said forward-most and intermediate extending portions, a second sub-plurality of said attachment pads being constructed according to a second configuration for use along said rearward portions.

12. The toilet seat attachment device according to claim 1, each of said support pads including a downwardly facing surface within which are formed a plurality of teethed portions.

13. A transportable and foldable toilet seat attachment device for use with a conventional toilet, the toilet including a bowl with an upwardly facing rim onto which is pivotably engaged a conventional toilet seat cover, said attachment device comprising:

a first generally arcuate shaped portion and a second likewise arcuate shaped portion being a substantially a mirror image of said first portion and being pivotally attached to said first portion at first and second respective and opposing ends established along a common axis, said first and second arcuate shaped portions each having an outer extending edge, a spaced and inner extending edge defining therebetween a selected width, an upwardly facing surface and a downwardly facing surface, said first and second arcuate portions further defining therebetween a central opening of a selected dimension;

a first handle extending from said outer extending edge of said first arcuate portion at a selected location, a second handle extending from said outer extending edge of said second arcuate portion at an opposite location relative to said first handle, said first and second handles each including resistive interengaging means such that, upon pivoting said first and second arcuate shaped portions from an unfolded and use position to a folded position, said handles interlock together and are adaptable to convert said attachment device for transport and storage;

drainage means incorporated within said downwardly facing surfaces of said arcuate shaped portions and said first and second handles for draining fluid from said attachment device; and first and second pluralities of elongate and radially extending support pads and securing means for attaching said pads to said downwardly facing surfaces of said first and second arcuate shaped portions, said pads resistively engaging the conventional toilet seat cover upon converting said attachment device to its unfolded and use position, said pads further spacing said upwardly facing surfaces from the corresponding upper surface of the toilet seat cover while centrally aligning said central opening with the upwardly facing toilet bowl rim.

* * * * *